US010670044B2

(12) United States Patent
Dossner et al.

(10) Patent No.: US 10,670,044 B2
(45) Date of Patent: Jun. 2, 2020

(54) AXIAL IMPELLER AND FAN HAVING SUCH AN AXIAL IMPELLER

(71) Applicant: VOITH PATENT GMBH, Heidenheim (DE)

(72) Inventors: Juergen Dossner, Bachhagel (DE); Martina Harsch, Heidenheim (DE)

(73) Assignee: Voith Patent GmbH, Heidenheim (DE)

( * ) Notice: Subject to any disclaimer, the term of this patent is extended or adjusted under 35 U.S.C. 154(b) by 173 days.

(21) Appl. No.: 15/556,178

(22) PCT Filed: Mar. 3, 2016

(86) PCT No.: PCT/EP2016/054505

§ 371 (c)(1),
(2) Date: Dec. 8, 2017

(87) PCT Pub. No.: WO2016/142255

PCT Pub. Date: Sep. 15, 2016

(65) Prior Publication Data

US 2018/0087527 A1 Mar. 29, 2018

(30) Foreign Application Priority Data

Mar. 11, 2015 (DE) ..... 10 2015 204 304

(51) Int. Cl.

| | |
|---|---|
| ***F04D 19/00*** | (2006.01) |
| ***F04D 29/38*** | (2006.01) |
| *F01P 5/06* | (2006.01) |

(52) U.S. Cl.
CPC ..... *F04D 29/384* (2013.01); *F04D 19/002* (2013.01); *F01P 5/06* (2013.01); *F05D 2240/303* (2013.01); *F05D 2240/304* (2013.01)

(58) Field of Classification Search
CPC combination set(s) only.
See application file for complete search history.

(56) References Cited

U.S. PATENT DOCUMENTS 5,326,225 A * 7/1994 Gallivan ..... F04D 29/164 416/169 A

FOREIGN PATENT DOCUMENTS

| | | |
|---|---|---|
| EP | 0945627 A1 | 9/1999 |
| EP | 1669610 A1 | 6/2006 |
| GB | 827670 A | 2/1959 |

* cited by examiner

*Primary Examiner* — Richard A Edgar
*Assistant Examiner* — Maxime M Adjagbe
(74) *Attorney, Agent, or Firm* — Laurence A. Greenberg; Werner H. Stemer; Ralph E. Locher

(57) ABSTRACT

An axial impeller for a fan or blower includes a hub and a plurality of blades. The geometry of the blades is determined by a course of a blade leading angle and of a blade trailing angle of blade sections from a blade root at the hub to a blade tip opposite the blade root, i.e., according to the hub ratio. The blade leading angle is curved to the left according to the hub ratio and/or the blade trailing angle is curved to the right according to the hub ratio and the blade leading angle is 29°±3° near the blade root and 14°±3° near the blade tip and/or the blade trailing angle is 69°±3° near the blade root and 27°±3° near the blade tip.

18 Claims, 4 Drawing Sheets

AXIAL IMPELLER AND FAN HAVING SUCH AN AXIAL IMPELLER

BACKGROUND OF THE INVENTION

Field of the Invention

The invention relates to an axial impeller having a hub and a blading, for a fan or blower, and to an axial fan having such an axial impeller.

In modern motor vehicles, fuel consumption plays an important role. Although utility vehicles such as in the construction or agricultural sectors were hitherto not affected by this development to such a great degree, more recently not only the internal combustion engines of such utility vehicles per se but also the power consumption of secondary consumers have been the focus of efforts to reduce fuel consumption. In addition to the pure power consumption, the limited installation space for such secondary consumers also plays an increasing role. One such important secondary consumer is the blower that is required for cooling the internal combustion engines. Here and in the remainder of the text, the terms "blower" and "fan" are used synonymously. Blowers of this type are nowadays generally designed as axial blowers. The axial blowers currently used for such purposes have impellers made of plastic and generally have an efficiency of between 50% and 60%. Hitherto, increasing the efficiency past 60% appeared to be impossible.

Axial blowers or axial fans have an impeller with a hub and a blading of the hub with a plurality of individual blades. The axis of rotation of the hub is parallel to the air stream. An individual blade extends along a longitudinal axis from its attachment at the hub, the blade root, to its blade tip. It is known to design the blades of an axial blower according to the laws of airfoils. To describe the geometry of a blade, planar sections perpendicular to a radial ray through the axis of rotation of the hub are considered at the radius in question. The individual sections each form a profile of the blade. The various profiles of such a blade can be identical along the blade longitudinal axis, but can also be of changing design. The progression of such profiles is described along what is referred to as a stacking line. The stacking line is understood to be the line connecting the geometric centroids of all of the blade sections or profiles.

The blade profile itself is described by various parameters and terms. The incident-flow edge of the profile is termed the leading edge, and the departing-flow edge is the trailing edge. The chord is a straight line connecting the leading edge and the trailing edge. A camber line also connects the leading edge and the trailing edge, and forms the midline of the profile. The camber line passes through the centers of the profile thicknesses, that is to say through the mid-points of all lines connecting the upper side and the underside of the profile, perpendicular to the chord.

A blade inlet angle or blade outlet angle is understood here as that angle enclosed by a tangent to the camber line and a straight line connecting either the leading edge or, respectively, the trailing edges. The blade inlet angle uses a tangent at the point at which the camber line meets the leading edge. similarly, the blade outlet angle uses a tangent at the point at which the camber line meets the trailing edge. The distance between the point at which the camber line meets the leading edge and the point at which the camber line meets the trailing edge, that is to say the length of the above-mentioned chord, is referred to here as the profile length.

The hub ratio is to be understood here as the quotient of the outer hub diameter—that is to say the minimum radius of a blade section—and the diameter at which a blade section of the blade is currently under consideration. The thickness ratio is to be understood as the ratio of the maximum profile thickness to the profile length. The solidity is to be understood as the distance between the trailing edges of the profiles of adjacent blades.

BRIEF SUMMARY OF THE INVENTION

The invention has the object of specifying an impeller for an axial blower or an axial fan with improved efficiency.

The object is achieved with an axial impeller having a hub and a blading for a fan or blower as claimed. Further embodiments of the invention are specified in the dependent claims.

The inventive geometry of the blades of the blading is determined by a progression of a blade inlet angle and/or of a blade outlet angle of blade sections. In that context, the angle progression is considered from a blade root at the hub to a blade tip opposite the blade root, that is to say the blade inlet angle and/or the blade outlet angle as a function of the hub ratio. It is provided, according to the invention and in the context of the axial impeller, that the blade inlet angle is left-curved as a function of the hub ratio, and/or the blade outlet angle is right-curved over the hub ratio and the blade inlet angle ($\beta_{f1}$) is 29°±3° in the vicinity of the blade root and is 14°±3° in the vicinity of the blade tip, and/or the blade outlet angle ($\beta_{f2}$) is 69°±3° in the vicinity of the blade root and/or is 27°±3° in the vicinity of the blade tip. The stated values are the result of computational fluid dynamics (CFD) calculations and laboratory testing in multiple iterative testing series on a large number of different profile geometries. The analysis showed that the stated limit values achieved a markedly improved laminar incident and departing flow, and as a consequence a marked improvement in efficiency.

In the present case, the terms left-curved and right-curved are to be understood as meaning that, in the case of a function representing the blade inlet angle or blade outlet angle as a function of the hub ratio, the second derivative is greater than zero (left-curved) or less than zero (right-curved). If the blade inlet angle and/or the blade outlet angle cannot be represented by a differentiable function—for example because the progression of the leading edge or of the trailing edge is composed of individual straight sections, for example for manufacturing reasons, then a fitted polynomial representing the blade inlet angle or the blade outlet angle as a function of the hub ratio should instead be considered as the function.

Therefore, according to the invention and with regard to the geometry of the blades of the axial impeller, the blade inlet angle and/or the blade outlet angle of a blade section changes as a function of the distance of the blade section from the hub with the stated limit values, and in particular the blade inlet angle and/or the blade outlet angle do not follow a linear dependency. Since a left-curvature or a right-curvature are present, the blade inlet angle and/or the blade outlet angle change more than would be the case with a linear dependency.

The inventive left- or right-curvature of the blade inlet angle and/or of the blade outlet angle of individual blade sections causes, in the case of a similar change in blade inlet angle and blade outlet angle, an apparent rotation or twisting of the blade sections along the stacking line. If the change in blade inlet angle and/or in blade outlet angle along the longitudinal axis or along the stacking line of the blade is not identical, then there is also a change in the camber line and therefore also in the curvature of the blade profile. The inventive twisting of the individual blades of the axial impeller according to the stated values with a super-linear progression of the blade inlet angle and/or of the blade outlet angle takes into account, according to the invention, the change in flow conditions in the progression from the hub or the blade root to the blade tip or a casing located there. Surprisingly, this super-linear twisting with the stated limit values results in an unexpected increase of up to 70% in the blade efficiency of the axial impeller, or of a fan or blower working with such an axial impeller. In that context, the blade efficiency $\eta_{Sch}$ is defined as $$\eta_{Sch} = \frac{\dot{m}_{Sch} Y_t}{\dot{m}_{Sch} Y_{Sch}} = \frac{Y_t}{Y_{Sch}},$$

where $\dot{m}_{Sch}$ is the mass flow rate through the blade region of the impeller, $Y_t$ is the specific discharge energy and $Y_{Sch}$ is the specific blade energy. Asymmetric twisting of the blade sections, that is to say greater twisting of the blade section in the region of the trailing edge than in the region of the leading edge, takes into account the different flow conditions at the leading edge and at the trailing edge, and contributes to further improvement in the overall efficiency of the axial impeller.

In a particularly preferred embodiment, it can be provided that the blade inlet angle, as a function of the hub ratio in at least a second blade inlet angle section from the blade root to the blade tip, first drops to a minimum and then rises again in the vicinity of the blade tip. The recovery of the twisting of the blade sections, which has already progressed to a minimum blade inlet angle, in the region of the blade tip leads to a further improvement in efficiency.

One preferred embodiment of the invention provides that a thickness ratio of the blading profile is between 0.05 and 0.16, and in particular drops from 0.13 to 0.08 from the blade root to the blade tip. Simultaneously or alternatively, the solidity can increase from 0.43 to 0.89 from the blade root to the blade tip.

In a particularly preferred embodiment, it is provided that the progression of the blade inlet angle as a function of the hub ratio is as per the following table:

| Hub ratio | Blade inlet angle [°] |
|---|---|
| 1.00 | 29.2 |
| 0.92 | 26.3 |
| 0.85 | 23.7 |
| 0.79 | 21.2 |
| 0.74 | 19.0 |
| 0.69 | 17.1 |
| 0.65 | 15.4 |
| 0.62 | 14.1 |
| 0.58 | 13.1 |
| 0.56 | 12.5 |
| 0.53 | 12.3 |
| 0.51 | 12.7 |
| 0.49 | 13.6 |

or that the progression of the blade inlet angle as a function of the hub ratio deviates from the above table values by at most +/−1°.

The non-linear progression, shown in this table, of the blade inlet angle as a function of the hub ratio indicates particularly optimized efficiencies.

In an also particularly preferred embodiment, it is provided that the progression of the blade outlet angle as a function of the hub ratio is as per the following table:

| Hub ratio | Blade outlet angle [°] |
|---|---|
| 1.00 | 68.8 |
| 0.92 | 67.5 |
| 0.85 | 66.0 |
| 0.79 | 64.2 |
| 0.74 | 62.0 |
| 0.69 | 59.4 |
| 0.65 | 56.6 |
| 0.62 | 53.3 |
| 0.58 | 49.6 |
| 0.56 | 45.3 |
| 0.53 | 40.1 |
| 0.51 | 34.1 |
| 0.49 | 27.0 |

or that the progression of the blade outlet angle as a function of the hub ratio deviates from the above table values by at most +/−2°.

In particular in cooperation with the above-mentioned progression of the blade inlet angle, the stated progression of the blade outlet angle as a function of the hub ratio leads to yet a further improvement in efficiency.

It is advantageous if the progression of the thickness ratio as a function of the hub ratio is as per the following table:

| Hub ratio | Thickness ratio |
|---|---|
| 1.00 | 0.130 |
| 0.92 | 0.115 |
| 0.85 | 0.107 |
| 0.79 | 0.101 |
| 0.74 | 0.097 |
| 0.69 | 0.093 |
| 0.65 | 0.090 |
| 0.62 | 0.088 |
| 0.58 | 0.086 |
| 0.56 | 0.083 |
| 0.53 | 0.080 |
| 0.51 | 0.080 |
| 0.49 | 0.080 |

or that the progression of the thickness ratio as a function of the hub ratio deviates from the above table values by at most +/−10%, preferably by at most +/−5%.

Adapting the thickness ratio to the indicated progression leads to a further improvement in efficiency.

In one embodiment, the progression of the solidity is as per the following table:

| Hub ratio | Solidity |
|---|---|
| 1.00 | 0.434 |
| 0.92 | 0.473 |
| 0.85 | 0.511 |
| 0.79 | 0.550 |
| 0.74 | 0.588 |
| 0.69 | 0.627 |
| 0.65 | 0.666 |
| 0.62 | 0.704 |
| 0.58 | 0.743 |
| 0.56 | 0.781 |
| 0.53 | 0.820 |
| 0.51 | 0.858 |
| 0.49 | 0.896 |

or that the progression of the solidity as a function of the hub ratio deviates from the above table values by at most +/−10%, preferably by at most +/−5%.

The change in solidity as a function of the hub ratio is also influenced by the increase in spacing with increasing radius.

The object is also achieved with an axial fan having a casing and an axial impeller according to the invention, in particular for a motor vehicle.

Particularly preferably, it is possible in the context of the axial fan that, during rotation of the axial impeller, there is provided between the casing and the blade tip a distance at the narrowest point of at most 1 mm, preferably at most 0.6 mm and at the widest point at most 5 mm, preferably at most 3 mm. This represents a particularly preferred combination of high efficiency and optimized flow guiding.

BRIEF DESCRIPTION OF THE SEVERAL VIEWS OF THE DRAWING

The invention will now be explained in greater detail with reference to the drawings, in which.

DESCRIPTION OF THE INVENTION

Figure 1:
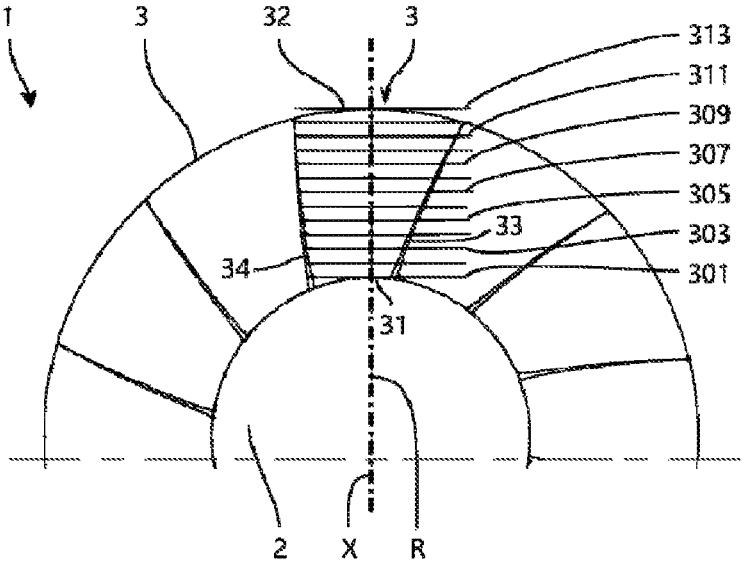
FIG. 1 shows a partially sectioned plan view of an axial impeller according to the invention.

FIG. 1 shows, in a partial plan view, an axial impeller 1 according to the invention which is for example suitable for an axial fan. The axial impeller 1 has a hub 2 that is mounted so as to be able to rotate about an axis of rotation X. A plurality of blades 3 is arranged on the hub 2. As shown in the plan view of FIG. 1, the blades are straight, that is to say that their stacking line (not shown) is a straight line. However, it would of course also be possible within the scope of the present invention to also provide the blades with a scimitar shape, also referred to as sweep. FIG. 1 shows 13 profile sections 301-313. These run perpendicular to a radial ray R passing through the axis of rotation X.

The blades 3 are rigidly attached to the hub 2 and have a blade root 31 and a blade tip 32. The incident-flow side of the blade 3 consists of a leading edge 33, the departing-flow side of the blade 3 consists of a trailing edge 34.

Figure 2:
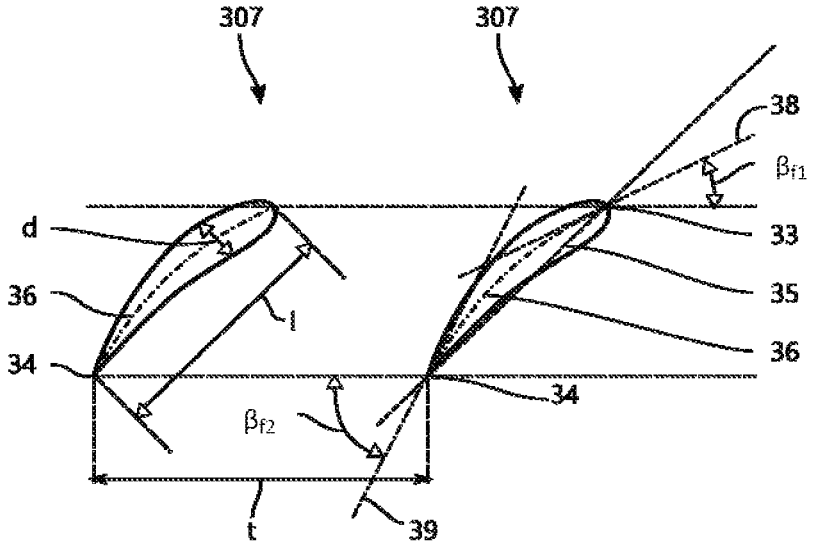
FIG. 2 shows two section views of the blade profile of a blade of FIG. 1.

FIG. 2 shows by way of example two blade sections 307 of two adjacent blades 3. The individual blade section 307 shows the profile of the blade 3. The profile has the leading edge 33 and the trailing edge 34.

A straight line connecting the leading edge 33 and the trailing edge 34 forms the chord 35. The length of the path between the leading edge 33 and the trailing edge 34 forms the profile length l. The distance between two trailing edges 34 represents the spacing t of the blading. The distance—perpendicular to the chord 35—between the upper side and the underside of the profile forms the thickness d of a profile. The camber line 36 runs through the middle of the thickness d. The camber line 36 is used to determine the blade inlet angle and the blade outlet angle. Tangents 38 and 39 are applied to the camber line 36 at the leading edge 33 and, respectively, the trailing edge 34. The angles respectively enclosed by the tangents 38 and 39 with a straight line respectively connecting the leading edges 33 and the trailing edges 34 of two adjacent blades 3 form the blade inlet angle $\beta_{f1}$ and $\beta_{f2}$.

Figure 3:
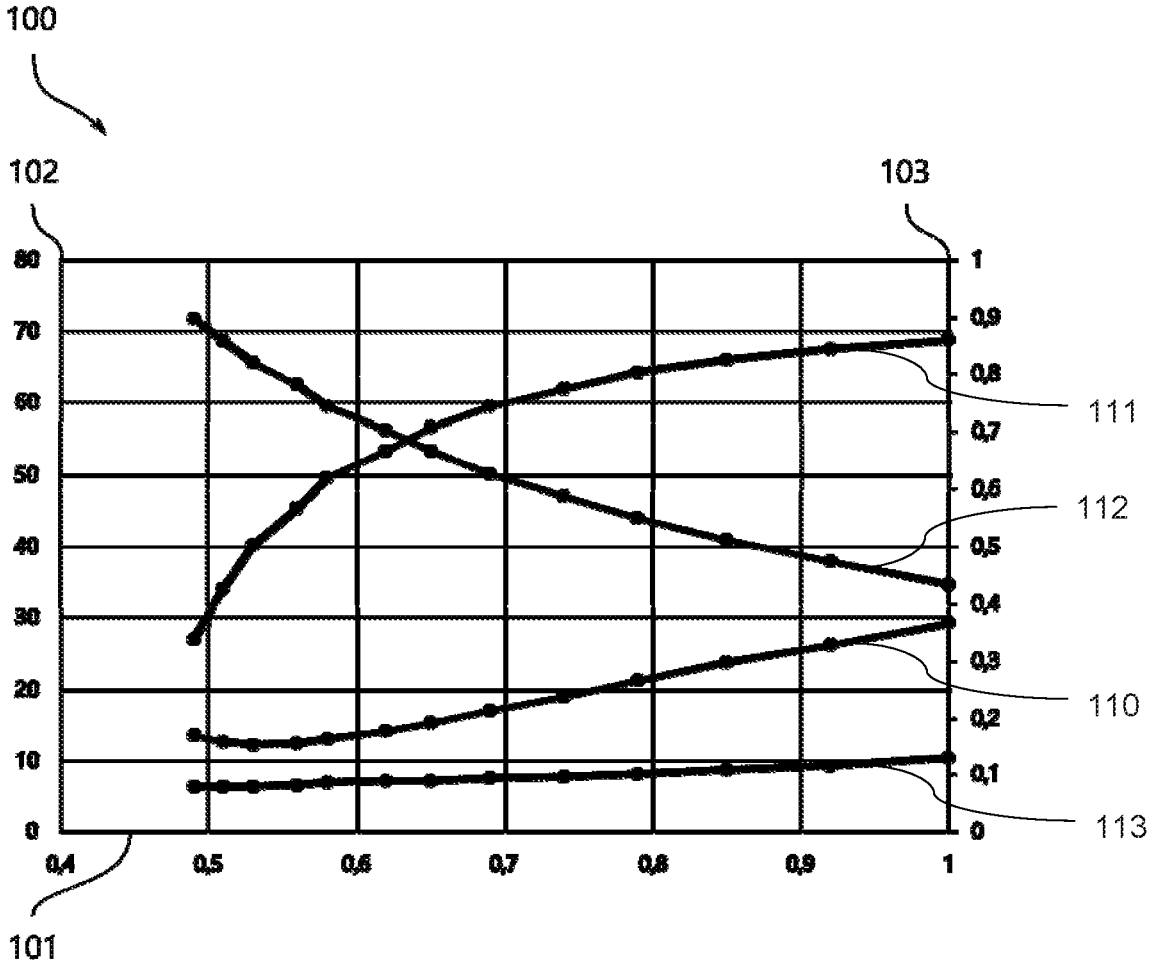
FIG. 3 shows a diagram for illustrating the blade inlet angle, the blade outlet angle, the solidity and the thickness ratio.

FIG. 3 shows a diagram 100 for illustrating the progression of the blade inlet angle, the blade outlet angle, the solidity and the thickness ratio. The abscissa 101 of the diagram 100 shows the hub ratio. In the present exemplary embodiment, the hub ratio varies between 1 and 0.43. The hub ratio is the quotient of the radius of the hub and the radius of the profile section currently under consideration. The left-hand ordinate 102 shows the angle for the blade inlet angle $\beta_{f1}$ and the blade outlet angle $\beta_{f2}$. The right-hand ordinate 103 shows the solidity and thickness ratio. The diagram 100 shows the graph 110 for the blade inlet angle $\beta_{f1}$ and the graph 111 for the blade outlet angle $\beta_{f2}$. The graph 112 shows the solidity and the graph 113 shows the thickness ratio. Between the hub ratio 0.65 and the hub ratio 0.43, the blade inlet angle $\beta_{f1}$ has a minimum at approximately 12°. At the maximum hub ratio of 0.43, the blade inlet angle $\beta_{f1}$ is 13.6°, at hub ratio 1 it is 29°.

The blade outlet angle $\beta_{f2}$, shown by graph 111, has its maximum of 69° at hub ratio 1 and then drops to 27° at the outer periphery, at hub ratio 0.43, without having a minimum in-between. In summary, FIG. 3 shows that the progression of the blade inlet angle and the blade outlet angle is super-linear.

The solidity t/l, determined by the quotient of the spacing t and the profile length l, increases from 0.43, at solidity 1, to 0.89 at the minimum solidity at the outer diameter. The thickness ratio d/l, determined by the quotient of the maximum thickness d and the profile length l, decreases from 0.13, at hub ratio 1, that is to say immediately adjacent to the hub, to 0.08 at the minimum hub ratio. The increase in solidity t/l accounts for the fact that the spacing t of an individual section increases with increasing distance outward from the hub. The decrease in thickness ratio d/l is due to the fact that the profile length l becomes shorter as the blade inlet angle and/or blade outlet angle changes.

The graphs 110, 111, 112, 113 show the progressions in accordance with the previously stated table values.

Figure 4:
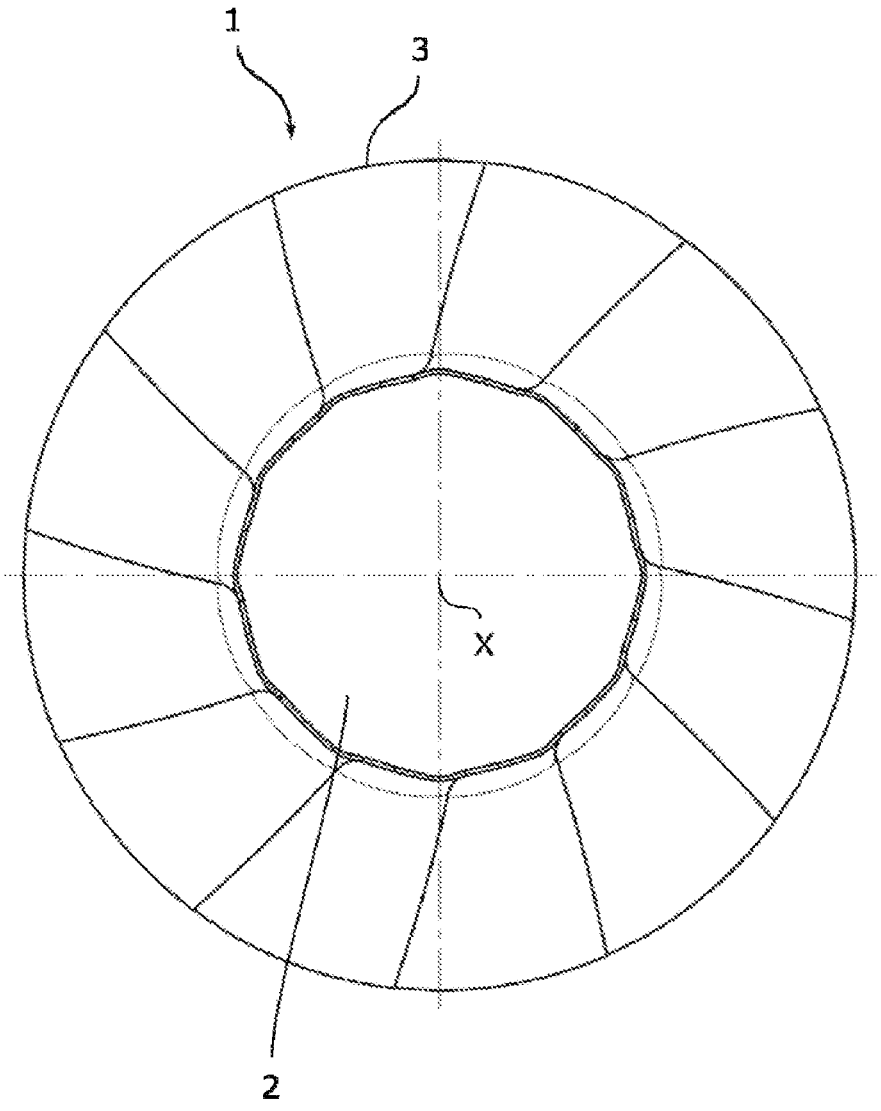
FIG. 4 shows a plan view of an axial impeller according to the invention.

FIG. 4 shows the axial impeller 1 of FIG. 1 in its entirety.

Figure 5:
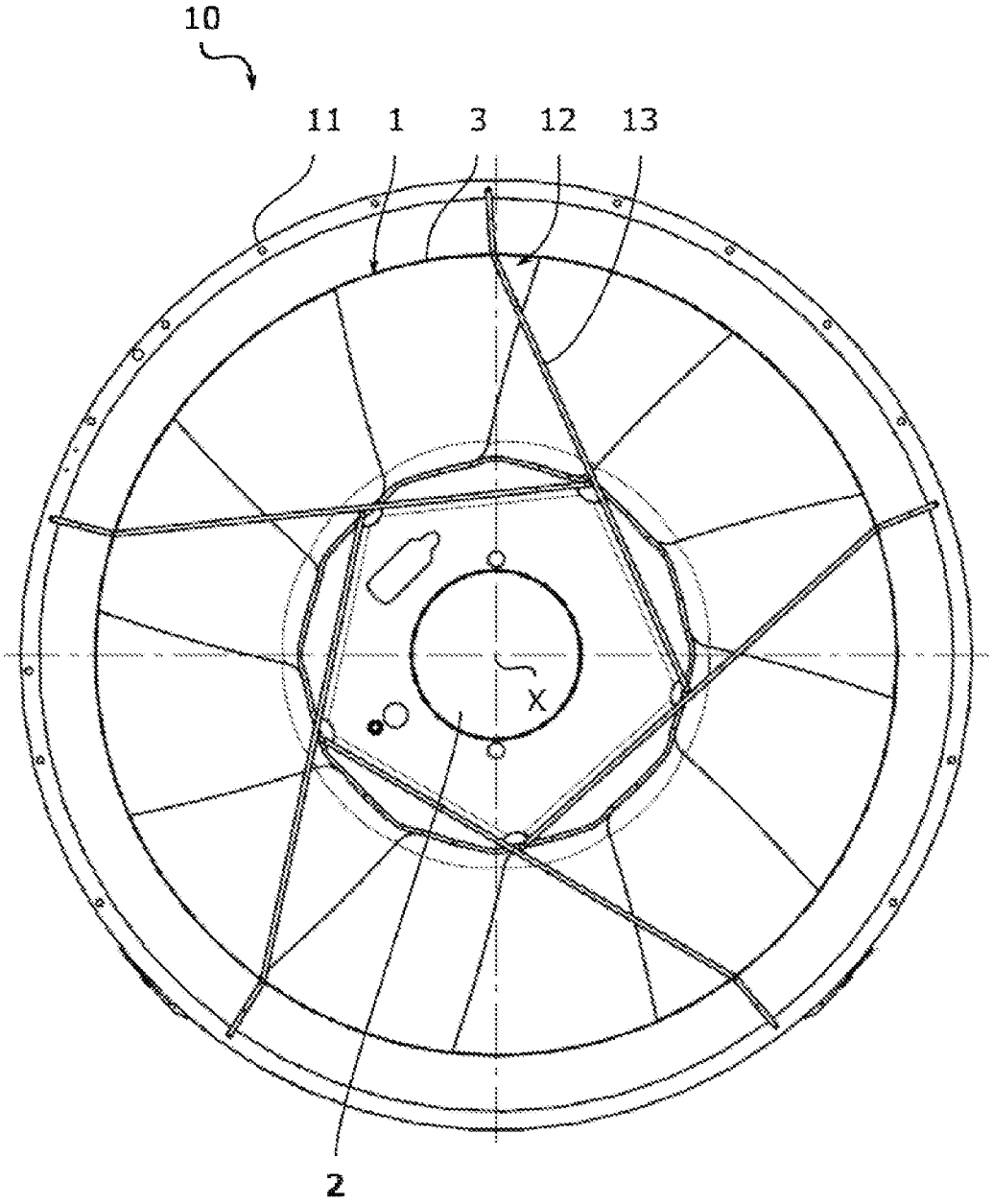
FIG. 5 shows a plan view of the impeller of FIG. 4, also showing an optional downstream stator ring.

FIG. 5 shows a fan 10 with the axial impeller 1 of FIGS. 1 and 4, and part of a casing 11. A motor mount 12 is attached to the casing 11. The motor mount 12 has an odd number of arms, which serve for attachment. A small gap is provided between the casing 11 and the axial impeller 1. The gap is at most 0.6 mm at the narrowest point and at most 3 mm at the widest point.

Typical values for the hub diameter of the present embodiment are 200-650 mm, for example 315 mm. Typical outer diameters for the axial impeller 1 are 400-1500 mm, for example 615 mm. The minimum hub ratio at the outer diameter is typically in the range 0.45-0.63. In the case of the chosen narrow gap between the axial impeller 1 and the casing 10, provision is preferably made, for manufacture of the axial impeller 1, of aluminum, for example chill-cast aluminum. It is however also possible to make such an axial impeller 1 out of plastic. However, this requires more effort to achieve the required precision.

The invention claimed is:

1. An axial impeller for a fan or a blower, the axial impeller comprising:

a hub and a blading with a plurality of blades attached to said hub;

each of said plurality of blades having a blade root at said hub and a blade tip opposite said blade root;

said blades having a geometry determined by a progression of a blade inlet angle and of a blade outlet angle along blade sections from said blade root to said blade tip;

wherein a hub ratio is defined as a ratio of a diameter of said hub to a diameter at which a given section is taken through a blade under consideration along a section perpendicular to a radial line;

wherein a progression of said blade inlet angle is left-curved with a curvature dependent on the hub ratio, a progression of said blade outlet angle is right-curved with a curvature dependent on the hub ratio and said blade inlet angle is 29°±3° at said blade root and is 14°±3° at said the blade tip, and said blade outlet angle is 69°±3° at said blade root and is 27°±3° at said blade tip.

2. The axial impeller according to claim 1, wherein the blade inlet angle, in dependence on the hub ratio from said blade root to said blade tip, first drops to a minimum and then rises again in the vicinity of said blade tip.

3. The axial impeller according to claim 1, wherein a difference between said blade inlet angle at said blade root and said blade inlet angle at said blade tip is smaller than a difference between said blade outlet angle at said blade root and said blade outlet angle at said blade tip.

4. The axial impeller according to claim 3, wherein the difference between said blade inlet angle at said blade root, defined when the hub ratio is 1, and said blade inlet angle at said blade tip, defined at a smallest hub ratio, is smaller than the difference between said blade outlet angle at said blade root, defined when the hub ratio is 1, and said blade outlet angle at said blade tip, defined at the smallest hub ratio.

5. The axial impeller according to claim 3, wherein the difference between said blade inlet angle at said blade root and said blade inlet angle at said blade tip amounts to one half the difference between said blade outlet angle at said blade root and said blade outlet angle at said blade tip.

6. The axial impeller according to claim 3, wherein the difference between said blade inlet angle at said blade root and said blade inlet angle at said blade tip amounts to 0.4 times the difference between said blade outlet angle at said blade root and said blade outlet angle at said blade tip.

7. The axial impeller according to claim 3, wherein the difference between said blade inlet angle at said blade root and said blade inlet angle at said blade tip amounts to 0.36 times the difference between said blade outlet angle at said blade root and said blade outlet angle at said blade tip.

8. The axial impeller according to claim 1, wherein a thickness ratio of a blading profile is defined as a quotient of a maximum thickness and a profile length of a blade, and the thickness ratio is between 0.05 and 0.16.

9. The axial impeller according to claim 1, wherein the progression of said blade inlet angle in dependence on the hub ratio is as per the following table:

| Hub ratio | Blade inlet angle [°] |
|---|---|
| 1.00 | 29.2 |
| 0.92 | 26.3 |
| 0.85 | 23.7 |
| 0.79 | 21.2 |
| 0.74 | 19.0 |
| 0.69 | 17.1 |
| 0.65 | 15.4 |
| 0.62 | 14.1 |
| 0.58 | 13.1 |
| 0.56 | 12.5 |

-continued

| Hub ratio | Blade inlet angle [°] |
|---|---|
| 0.53 | 12.3 |
| 0.51 | 12.7 |
| 0.49 | 13.6 |

and the progression of the blade inlet angle in dependence on the hub ratio deviates from the above table values by at most +/−1°.

10. The axial impeller according to claim 1, wherein the progression of said blade outlet angle in dependence on the hub ratio is as per the following table:

| Hub ratio | Blade outlet angle [°] |
|---|---|
| 1.00 | 68.8 |
| 0.92 | 67.5 |
| 0.85 | 66.0 |
| 0.79 | 64.2 |
| 0.74 | 62.0 |
| 0.69 | 59.4 |
| 0.65 | 56.6 |
| 0.62 | 53.3 |
| 0.58 | 49.6 |
| 0.56 | 45.3 |
| 0.53 | 40.1 |
| 0.51 | 34.1 |
| 0.49 | 27.0 |

and the progression of the blade outlet angle in dependence on the hub ratio deviates from the above table values by at most +/−2°.

11. The axial impeller according to claim 1, wherein a thickness ratio is defined as a quotient of a maximum thickness and a profile length of a blade, and the progression of the thickness ratio in dependence on the hub ratio is as per the following table:

| Hub ratio | Thickness ratio |
|---|---|
| 1.00 | 0.130 |
| 0.92 | 0.115 |
| 0.85 | 0.107 |
| 0.79 | 0.101 |
| 0.74 | 0.097 |
| 0.69 | 0.093 |
| 0.65 | 0.090 |
| 0.62 | 0.088 |
| 0.58 | 0.086 |
| 0.56 | 0.083 |
| 0.53 | 0.080 |
| 0.51 | 0.080 |
| 0.49 | 0.080 |

and the progression of the thickness ratio in dependence on the hub ratio deviates from the above table values by at most +/−10%.

12. The axial impeller according to claim 11, wherein the progression of the thickness ratio in dependence on the hub ratio deviates from the table values by no more than +/−5%.

13. The axial impeller according to claim 1, wherein a solidity is defined as a quotient of a spacing between adjacent blades and a profile length, and the progression of the solidity is as per the following table:

| Hub ratio | Solidity |
|---|---|
| 1.00 | 0.434 |
| 0.92 | 0.473 |
| 0.85 | 0.511 |
| 0.79 | 0.550 |
| 0.74 | 0.588 |
| 0.69 | 0.627 |
| 0.65 | 0.666 |
| 0.62 | 0.704 |
| 0.58 | 0.743 |
| 0.56 | 0.781 |
| 0.53 | 0.820 |
| 0.51 | 0.858 |
| 0.49 | 0.896 |

and the progression of the solidity in dependence on the hub ratio deviates from the above table values by at most +/−10%.

14. The axial impeller according to claim 13, wherein the progression of the solidity in dependence on the hub ratio deviates from the table values by no more than +/−5%.

15. An axial fan, comprising a casing and an axial impeller according to claim 1 disposed in said casing.

16. The axial fan according to claim 15 configured for a motor vehicle.

17. The axial fan according to claim 15, wherein, during rotation of the axial impeller, a distance between said casing and the blade tip at a narrowest point amounts to no more than 1 mm and the distance between said casing and the blade tip at a widest point amounts to no more than 5 mm.

18. The axial fan according to claim 17, wherein the distance at the narrowest point amounts to no more than 0.6 mm and the distance at the widest point amounts to no more than 3 mm.

* * * * *